US007281650B1

(12) United States Patent
Milan

(10) Patent No.: US 7,281,650 B1
(45) Date of Patent: Oct. 16, 2007

(54) BEVERAGE CUP

(76) Inventor: Michael Milan, 8200 Sparger St., McLean, VA (US) 22102

( * ) Notice: Subject to any disclaimer, the term of this patent is extended or adjusted under 35 U.S.C. 154(b) by 164 days.

(21) Appl. No.: 11/089,853

(22) Filed: Mar. 24, 2005

(51) Int. Cl.
*B65D 3/22* (2006.01)
*B65D 3/28* (2006.01)

(52) U.S. Cl. ..... 229/403; 229/4.5; 229/400

(58) Field of Classification Search ..... 229/4.5, 229/400, 403; 220/676, 737, 738, 739
See application file for complete search history.

(56) References Cited

U.S. PATENT DOCUMENTS 1,407,688 A * 2/1922 Banton ..... 220/676
2,661,889 A 12/1953 Phinney
2,695,744 A 11/1954 Gattuso
2,853,222 A * 9/1958 Gallagher ..... 229/403
2,973,295 A * 2/1961 Rodgers, Jr. ..... 428/182
3,203,611 A * 8/1965 Anderson et al. ..... 229/403
3,344,973 A * 10/1967 Studen ..... 229/5.84
3,345,245 A * 10/1967 Hanusa ..... 229/939
3,434,849 A * 3/1969 Carbone ..... 229/5.82
3,908,523 A 9/1975 Shikaya
4,993,580 A 2/1991 Smith
5,125,566 A * 6/1992 Deiger ..... 229/125.15
5,542,599 A 8/1996 Sobol
5,628,453 A 5/1997 MacLaughlin
5,660,326 A 8/1997 Varano
5,685,480 A 11/1997 Choi
5,697,550 A 12/1997 Varano et al.
5,766,709 A * 6/1998 Geddes et al. ..... 428/35.7
6,030,476 A 2/2000 Geddes et al.
6,085,970 A 7/2000 Sadler
6,116,503 A 9/2000 Varano
6,565,934 B1 5/2003 Fredricks
6,811,843 B2 * 11/2004 DeBraal et al. ..... 428/34.2
6,926,197 B2 * 8/2005 Hed et al. ..... 229/403

* cited by examiner

*Primary Examiner*—Gary E. Elkins
(74) *Attorney, Agent, or Firm*—Jack Munro; Sandy Lipkin

(57) ABSTRACT

A beverage cup that is constructed to be inexpensive and disposable with the beverage cup having an anti-slip exterior surface. The anti-slip exterior surface can be constructed of a foam coating or constructed by placing a mass of small holes through a corrugated layer producing a chad around each hole that extends in an outward direction from the beverage cup.

2 Claims, 1 Drawing Sheet

BEVERAGE CUP

BACKGROUND OF THE INVENTION

1. Field of the Invention

The present invention relates to cups and more particularly to disposable cups intended for containing hot beverages, such as coffee, tea and soup.

2. Description of the Related Art

In this day of fast food restaurants, disposable beverage cups are commonly used. A simple paper cup can be used when the beverage is cold. However when the beverage is hot and contains such things as coffee, tea, soup or the like, the heat from the heated liquid can readily penetrate through the sidewall of the beverage cup making it literally impossible for the consumer to hold the beverage cup with a bare hand.

In the past, it has been known to make beverage cups from an expanded resin material which is sold under the trademark styrofoam. Such cups are excellent thermal insulators and not only can be used to prevent the burning of a consumer's hand when utilizing of hot beverages but also for cold beverages. Such cups will tend to maintain the beverage colder for a longer period of time. Such cups are comfortable to use as the exterior surface of the cup stays close to ambient temperature regardless of the temperature of the ingredients within the cup. However, such cups are environmentally unfriendly because they are not biodegradable or recyclable. If such a cup is merely discarded into the environment by a careless or uncaring individual, the cup does not deteriorate and will remain creating a blighted appearance in the environment. Such cups, when discarded in landfills, will remain intact for literally thousands of years since deterioration does not occur.

A more environmentally acceptable beverage cup is one composed of paper which is biodegradable and in which the principal constituent is cellulose or vegetable fiber. The container surface of the cup is rendered liquid-proof by coating of the surface with a thin coating of a paraffin or microcrystalline wax for a cold beverage or with a thin coating of a synthetic high polymer having a high melting point, such as polypropylene or polyethylene for hot beverages. However, heat exchange from the container of the beverage cup through the sidewall of the beverage cup is rapid and if it is an especially hot liquid, such as coffee, tea or soup, that liquid can easily burn the consumer's hand.

In the past, it has been known to construct the sidewall of a paper cup in a manner to insulate the consumer's hand from the heat of the liquid contained within the beverage cup. It has been known to coat the exterior sidewall of the beverage cup with a foam coating which insulates from the transfer of heat. It has also been known to construct a sidewall of the beverage cup of a corrugated paper which has a lot of open air cells which again function to insulate the consumer's hand from the heat contained within liquid in the beverage cup. However in the past, some constructions have proved to be quite expensive as if a manufacturer is to enjoy widespread marketing of such a cup, it has to be manufactured at a very inexpensive price. A very inexpensive price is around a penny per cup. There is a need to construct a paper cup to thermally insulate the consumer's hand and having this paper cup to be manufactured most inexpensively.

SUMMARY OF THE INVENTION

The first basic embodiment of the present invention is directed to a beverage cup that has a sidewall that encloses a chamber with the sidewall being constructed of an inner layer constructed of paper where the inner layer has an interior surface and an exterior surface. The interior surface is coated with a substance to prevent soaking of any liquid by the inner layer. The exterior surface has a glue layer applied thereto. A corrugated outer paper layer is adhesively secured by the glue layer to the exterior surface. The corrugated outer paper layer has an outer surface. The corrugated outer paper layer has a mass of holes with each hole of the holes extending from the glue layer through the outer surface. Each hole of the holes is open at its outer surface.

A further embodiment of the present invention is where the first basic embodiment is modified by defining that each of the holes have a chad that protrudes outward from the outer surface and all the chads taken in combination with all the holes producing an anti-slip gripping surface which will deter the beverage cup from accidentally falling free from a human hand.

A second basic embodiment of the present invention is directed to the constructing of a beverage cup having a sidewall that encloses a chamber with the sidewall being constructed of an inner layer of paper with this inner layer having an interior surface and an exterior surface. The interior surface is coated with a substance to prevent soaking of any liquid by the inner layer. The exterior layer has a glue layer applied thereto. A corrugated outer paper layer is adhesively secured by the glue layer to the exterior surface. The corrugated outer paper layer has an outside surface. A plastic foam coating is applied to this outside layer whereby the plastic foam coating is to provide an anti-slip surface.

A further embodiment of the present invention is where the second basic embodiment is modified by defining that the foam is constructed from either polypropylene or polyethylene.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
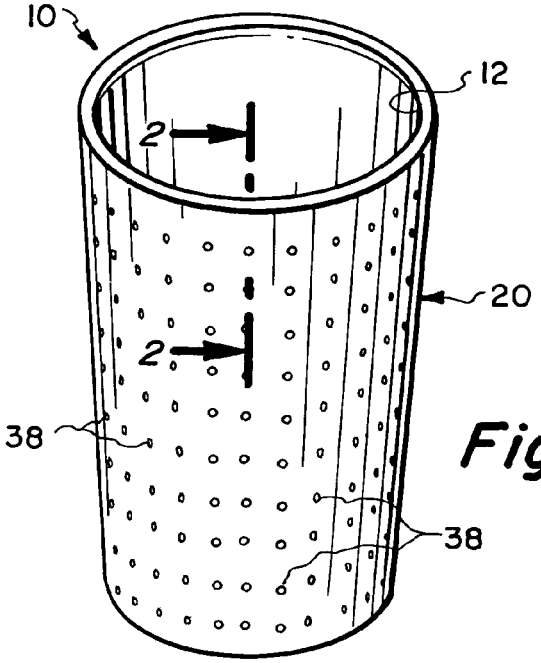
FIG. 1 is an isometric view of a first embodiment of beverage cup of the present invention.
Figure 2:
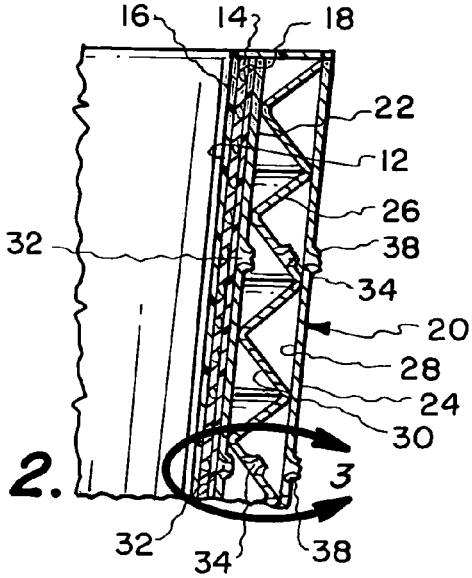
FIG. 2 is a cross-sectional view taken along line 2-2 of FIG. 1.
Figure 3:
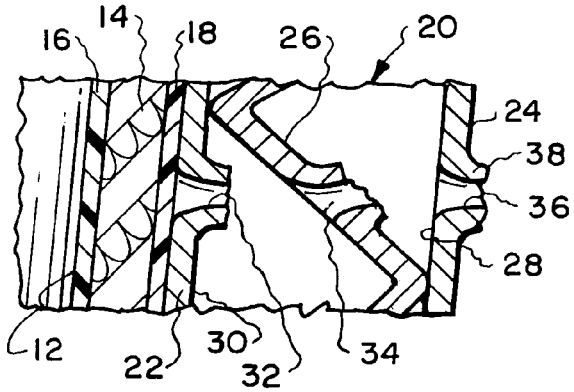
FIG. 3 is an exploded cross-sectional view taken along line 3-3 of FIG. 2.

Referring particularly to FIGS. 1–3 of the drawings, there is shown the first embodiment 10 of beverage cup of this invention. The first embodiment 10 has a sidewall which encloses a liquid receiving chamber 12. The first embodiment 10 has a closed bottom, which is not shown, which is deemed to be conventional. The sidewall is constructed as follows. There is a paper layer 14. It is to be understood that the paper layer 14 is continuous and is formed basically into a cylinder, but the cylinder has a slight tapered configuration with it being narrower at the bottom of the beverage cup and wider at the open mouth of the beverage cup which provides access into the chamber 12. The inner surface of the paper layer 14 is coated with a substance that prevents liquid to be absorbed by the paper layer 14. The substance is shown as coating 16. This substance of coating 16 can comprise a paraffin or microcrystalline wax which would be for a cup 10 that is used for cold beverages or could comprise a synthetic high polymer having a high melting point, such as polypropylene or polyethylene, which is for hot beverages. The coating 16 is to be evenly applied throughout all surfaces of the chamber 12.

Onto the exterior surface of the paper layer 14 is a layer of glue 18. The glue 18 is to comprise any conventional non-toxic adhesive which is to be applied in liquid form. Onto the glue 18 is to be applied an outer layer 20. The outer layer 20 is composed of an inside sheet material paper layer 22 and an outside sheet material paper layer 24. Both layers 22 and 24 are formed of paper. In between the layers 22 and 24 is located a corrugated layer 26 with this corrugated layer 26, in transverse cross-section, being basically sinusoidal shaped. The corrugated layer 26 is also formed of paper. Because of the construction of the corrugated layer 26, there are formed a plurality of outside air pockets 28 and a plurality of inside air pockets 30. It is the air pockets 28 and 30 that provide the insulation that prevents the conducting of heat from the beverage contained within the chamber 12 to be conducted to the outside sheet material paper layer 24.

Prior to the mounting of the outer layer 20 onto the glue 18, the outer layer 20 is perforated by there being inserted needle-like tools (not shown) through the inside sheet material paper layer 22, then through the corrugated layer 26 and then exteriorly of the outside sheet material layer 24. The result is a hole 32 is formed within the inside sheet material paper layer 22 with there also being produced an aligned hole 34 within the corrugated layer 26 and a third aligned hole 36 within the outside sheet material paper layer 24 for each set of aligned holes 32, 34 and 36. It is to be understood that there will actually be formed hundreds of holes 32, 34 and 36 within the outer layer 20. Surrounding each of the holes 36 is a annular raised member that is defined as a chad 38. These chads 38 create a non-slip gripping surface that when gripped by a human user will deter accidental disengagement of the first embodiment of beverage cup 10 of this invention from the user's hand.

Figure 4:
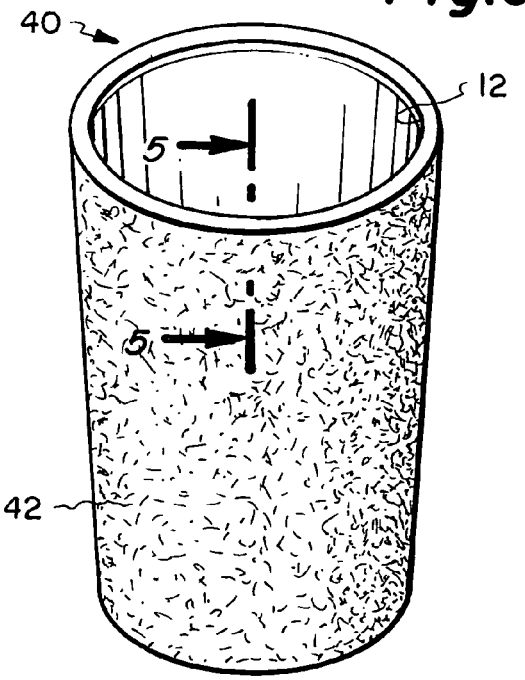
FIG. 4 is an isometric view of a second embodiment of beverage cup of the present invention.
Figure 5:
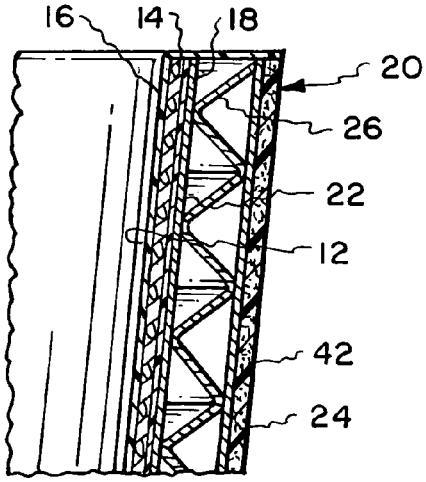
FIG. 5 is a cross-sectional view taken along line 5-5 of FIG. 4.

Referring particularly to FIGS. 4 and 5 of the drawings, there is shown the second embodiment 40 of beverage cup of this invention. Like numbers have been utilized to refer to like parts relative to the first embodiment 10. The only real difference of the second embodiment 40 relative to the first embodiment 10 is that there are no holes 32, 34 and 36. However, applied onto the exterior surface of outside sheet material layer 24 is a foam coating 42. A typical material of construction for the foam coating 42 would be a polyethylene or polypropylene. The foam coating 42 is to comprise an expanded resin type of coating which is to be sprayed in liquid form onto the outside sheet material layer 24. Actually, the coating 42 will be applied onto the outer layer 20 when the outer layer 20 is in sheet form and prior to installation onto the glue 18.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A beverage cup having a sidewall that encloses a chamber, said sidewall being constructed as follows:

an inner layer construction of paper, said inner layer having an interior surface and an exterior surface, said interior surface being coated with a substance to prevent soaking of any liquid by said inner layer, said exterior surface having a glue layer applied thereto;

a corrugated outer paper layer adhesively secured by said glue layer to said exterior surface, said corrugated outer paper layer having an outside surface, said corrugated outer paper layer having a mass of holes with each of said holes extending from said glue layer through said outside surface, each hole of said holes being open at said outside surface.

2. The beverage cup as defined in claim 1 wherein:

each of said holes having a chad that protrudes outward from said outside surface, said chad in combination with chads of all of said holes producing an anti-slip gripping surface which will deter said beverage cup from accidentally falling free from a human hand.

* * * * *